US009389590B2

(12) United States Patent
Kakizawa

(10) Patent No.: US 9,389,590 B2
(45) Date of Patent: Jul. 12, 2016

(54) TIMEPIECE

(71) Applicant: SEIKO EPSON CORPORATION, Tokyo (JP)

(72) Inventor: Yukihisa Kakizawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/930,780

(22) Filed: Nov. 3, 2015

(65) Prior Publication Data

US 2016/0154382 A1 Jun. 2, 2016

(30) Foreign Application Priority Data

Nov. 28, 2014 (JP) ..... 2014-241479

(51) Int. Cl.

| | |
|---|---|
| ***G04B 19/06*** | (2006.01) |
| ***G04B 19/24*** | (2006.01) |
| ***G04B 19/243*** | (2006.01) |
| *G04B 19/247* | (2006.01) |

(52) U.S. Cl.

CPC ..... *G04B 19/243* (2013.01); *G04B 19/06* (2013.01); *G04B 19/247* (2013.01)

(58) Field of Classification Search

CPC ..... G04B 19/06; G04B 19/24; G04B 19/243; G04B 119/247

See application file for complete search history.

(56) References Cited

U.S. PATENT DOCUMENTS

| | | | | | |
|---|---|---|---|---|---|
| 3,712,043 | A * | 1/1973 | Egger | G04B 19/24 | 368/37 |
| 3,811,266 | A * | 5/1974 | Samura | G04B 47/003 | 368/35 |
| 3,842,590 | A * | 10/1974 | Kato | G04B 47/003 | 368/319 |
| 4,124,975 | A * | 11/1978 | Morozumi | G04B 19/24 | 368/37 |
| 8,467,271 | B2 * | 6/2013 | Hirokawa | G04B 19/247 | 368/37 |
| 2008/0144443 | A1 * | 6/2008 | Herbert | G04C 17/0058 | 368/21 |

FOREIGN PATENT DOCUMENTS

| | | | |
|---|---|---|---|
| JP | 2012-083148 | A | 4/2012 |
| JP | 2012-189398 | A | 10/2012 |

* cited by examiner

*Primary Examiner* — Vit W Miska
(74) *Attorney, Agent, or Firm* — Global IP Counselors, LLP

(57) ABSTRACT

A timepiece includes a dial, a day dial disposed on the rear side of the dial, and a movement that rotates the day dial by a predetermined angle every day. Seven openings corresponding to the seven days of the week are formed in the order thereof in the dial, and a mark is formed on a surface of the day dial on the side facing the dial. Whenever the day dial rotates by the predetermined angle, the mark sequentially appears in the order of the days of the week through one of the seven openings when the dial is viewed from the front side.

8 Claims, 8 Drawing Sheets

TIMEPIECE

BACKGROUND

1. Technical Field

The present invention relates to a timepiece that displays the day of the week.

2. Related Art

There is a known timepiece that displays a day of the week as well as time (see JP-A-2012-83148, for example).

The timepiece according to JP-A-2012-83148 includes a dial through which a plurality of windows are formed and a day dial which is disposed below the dial and on which a plurality of patterns displayable through the windows are set, and the day dial is so configured that it rotates by a predetermined angle every day to provide seven types of combined pattern displayed through the plurality of windows whenever the day dial rotates by the predetermined angle. According to the configuration, a day of the week can be displayed based on a combined pattern displayed through the plurality of windows.

In the timepiece according to JP-A-2012-83148, however, since it is difficult for a user to grasp the day of the week unless the user understands in advance which combined pattern displayed through the plurality of windows represents which day of the week.

SUMMARY

An advantage of some aspects of the invention is to provide a timepiece that allows a user to readily grasp the day of the week.

A timepiece according to an aspect of the invention includes a dial, a day dial disposed on a rear side of the dial, and a movement that rotates the day dial by a predetermined angle every day. Seven openings corresponding to the seven days of the week are formed in the order thereof in the dial, and a mark is formed on a surface of the day dial on the side facing the dial. Whenever the day dial rotates by the predetermined angle, the mark sequentially appears in the order of the days of the week through one of the seven openings when the dial is viewed from a front side.

The mark is, for example, a formed object having a predetermined area or a formed object that displays a symbol.

In the aspect of the invention, the seven openings corresponding to the seven days of the week are formed in the order thereof in the dial, and the mark sequentially appears in the order of the days of the week through one of the seven openings whenever the day dial rotates by the predetermined angle.

The user can therefore intuitively grasp the day of the week by recognizing which opening numbered in the arrangement order of the seven openings the mark appears through.

For example, in a case where seven openings are formed in the order of the days of the week, from an opening corresponding to Sunday to an opening corresponding to Saturday, when the mark appears, for example, through the fourth opening, the user can intuitively grasp that the timepiece indicates Wednesday.

In the timepiece according to the aspect of the invention, it is preferable that the seven openings are arranged at predetermined intervals.

In the aspect of the invention with this configuration, since the seven openings are arranged at predetermined intervals, the user can readily grasp which opening numbered in the arrangement order of the seven openings the mark appears through, as compared with a case where the openings are arranged at randomly varying intervals.

In the timepiece according to the aspect of the invention, it is preferable that the seven openings are arranged in the order of the days of the week in a direction parallel to a straight line connecting a 12-o'clock position to a 6-o'clock position on the dial and oriented from the 12-o'clock position toward the 6-o'clock position.

Since the 12-o'clock position is located above and the 6-o'clock position is located below when the timepiece is viewed from the front, the seven openings are arranged from above to below in the order of the days of the week. In a case where the days of the week are vertically arranged, since the days of the week are typically arranged from above to below in the order of the days of the week in many cases, arranging the seven openings from above to below in the order of the days of the week allows the user to readily grasp the day of the week.

In the timepiece according to the aspect of the invention, it is preferable that the seven openings are arranged in the order of the days of the week in a direction parallel to a straight line connecting a 9-o'clock position to a 3-o'clock position on the dial and oriented from the 9-o'clock position toward the 3-o'clock position.

Since the 9-o'clock position is located left and the 3-o'clock position is located right when the timepiece is viewed from the front, the seven openings are arranged from left to right in the order of the days of the week, as in the case of the days of the week in a typical calendar. The user can therefore readily grasp the day of the week.

In the timepiece according to the aspect of the invention, it is preferable that the mark is colored in a single color.

The mark can therefore be readily formed, as compared with a case where the mark is colored in a plurality of colors.

In the timepiece according to the aspect of the invention, it is preferable that the mark is formed of a plurality of mark portions that appear through different openings of the seven openings, and that the colors of the plurality of mark portions are set in accordance with the days of the week related to the openings through which the marks appear.

According to the aspect of the invention with this configuration, the user can also grasp the day of the week (Sunday, Saturday, or any other day of the week) based on the color of the mark portion that appears through one of the openings.

In the timepiece according to the aspect of the invention, it is preferable that symbols representing the days of the week are displayed on the dial in correspondence with the seven openings.

According to the aspect of the invention with this configuration, the user can further grasp which day of the week is indicated by the opening through which the mark appears by visually recognizing the corresponding symbol displayed on the dial, whereby the user can more readily grasp the day of the week.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below with reference to the drawings.

First Embodiment

Configuration of Timepiece

Figure 1:
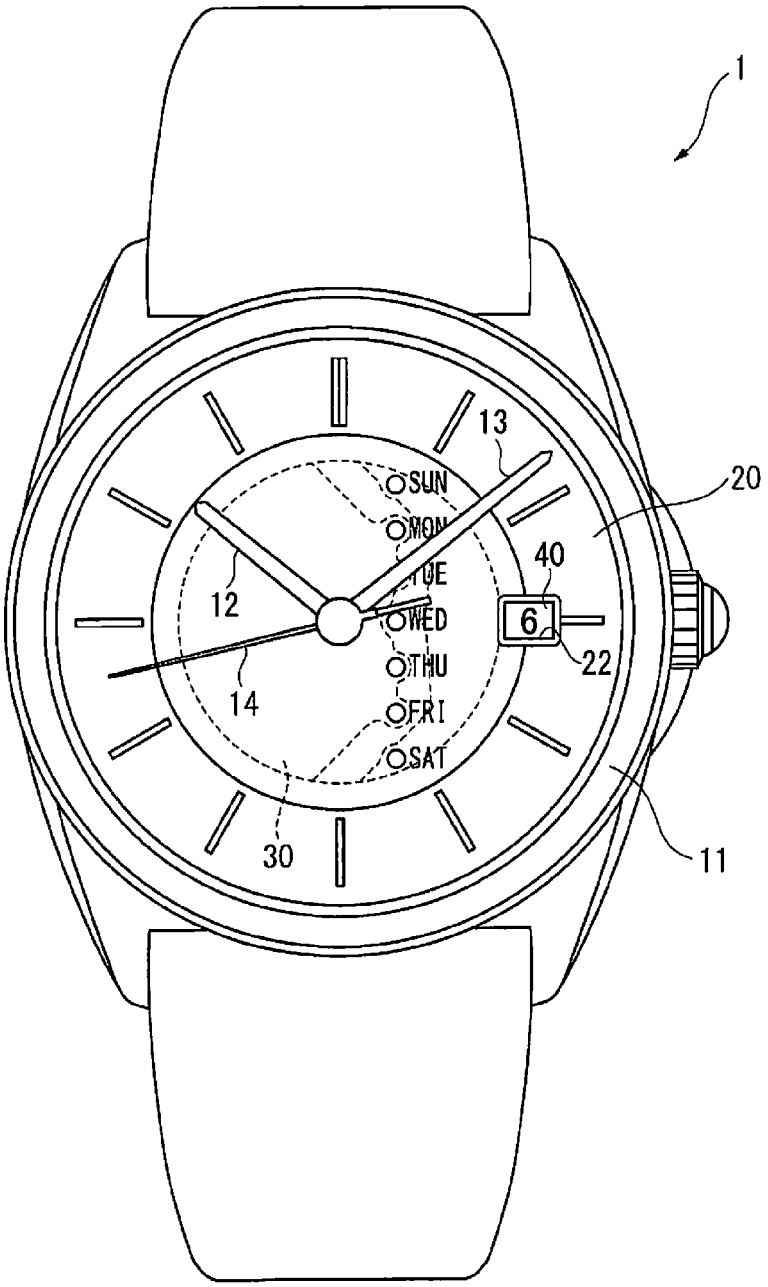
FIG. 1 is a plan view of a timepiece according to a first embodiment of the invention.

FIG. 1 is a plan view of a timepiece 1. The timepiece 1 is a wristwatch having a function of displaying time, date, and the day of the week.

The timepiece 1 includes an exterior case 11 and an hour hand 12, a minute hand 13, a second hand 14, a dial 20, a day indicator 30, a date indicator 40, and a movement 50 (see FIG. 3) disposed in the exterior case 11, as shown in FIG. 1.

The hour hand 12, the minute hand 13, and the second hand 14 are disposed on the front side of the dial 20 and point at portions of the dial 20 to display time.

The day indicator 30 and the date indicator 40 are disposed on the rear side of the dial 20.

The movement 50 is disposed on the rear side of the day indicator 30 and the date indicator 40 and rotates and drives the hour hand 12, the minute hand 13, the second hand 14, the day indicator 30, and the date indicator 40.

Configuration of Dial

Figure 2:
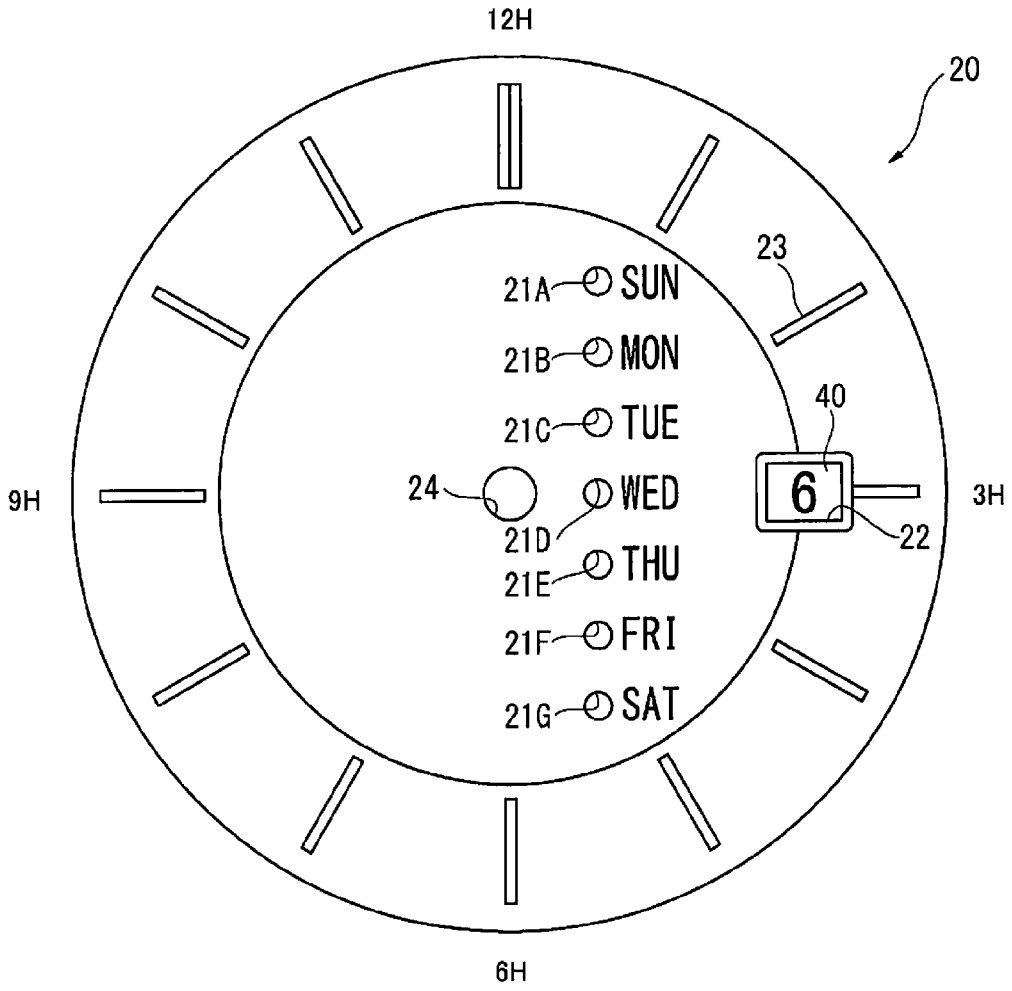
FIG. 2 is a plan view of a dial in the first embodiment.

FIG. 2 is a plan view of the dial 20. The dial 20 is formed in a disk-like shape.

Through the dial 20 are formed seven openings 21A to 21G corresponding to the seven days of the week (Sunday, Monday, Tuesday, Wednesday, Thursday, Friday, and Saturday) on the side shifted from the center line connecting the 12-o'clock position to the 6-o'clock position toward the 3-o'clock position and in the direction parallel to the center line and oriented from the 12-o'clock position toward the 6-o'clock position in the order of the days of the week, that is, from Sunday to Saturday.

The openings 21A to 21G are each formed in a circular shape and are arranged at predetermined intervals. That is, the openings 21A to 21G are arranged at equal intervals.

Symbols representing the days of the week are displayed on the dial 20 in correspondence with the openings 21A to 21G. In the present embodiment, characters SUN, MON, TUE, WED, THU, FRI, and SAT are displayed as the symbols.

In addition to the above, the dial 20 has an opening 22 formed in the 3-o'clock position, and the opening 22 makes a date displayed on the date indicator 40 visible. Further, markings 23 for time display are formed at the periphery of the dial 20, and an insertion hole 24, through which an indication hand shaft that supports the indication hands 12 to 14 is inserted, is formed at the center of the dial 20.

Configuration of Date Indicator

Figure 3:
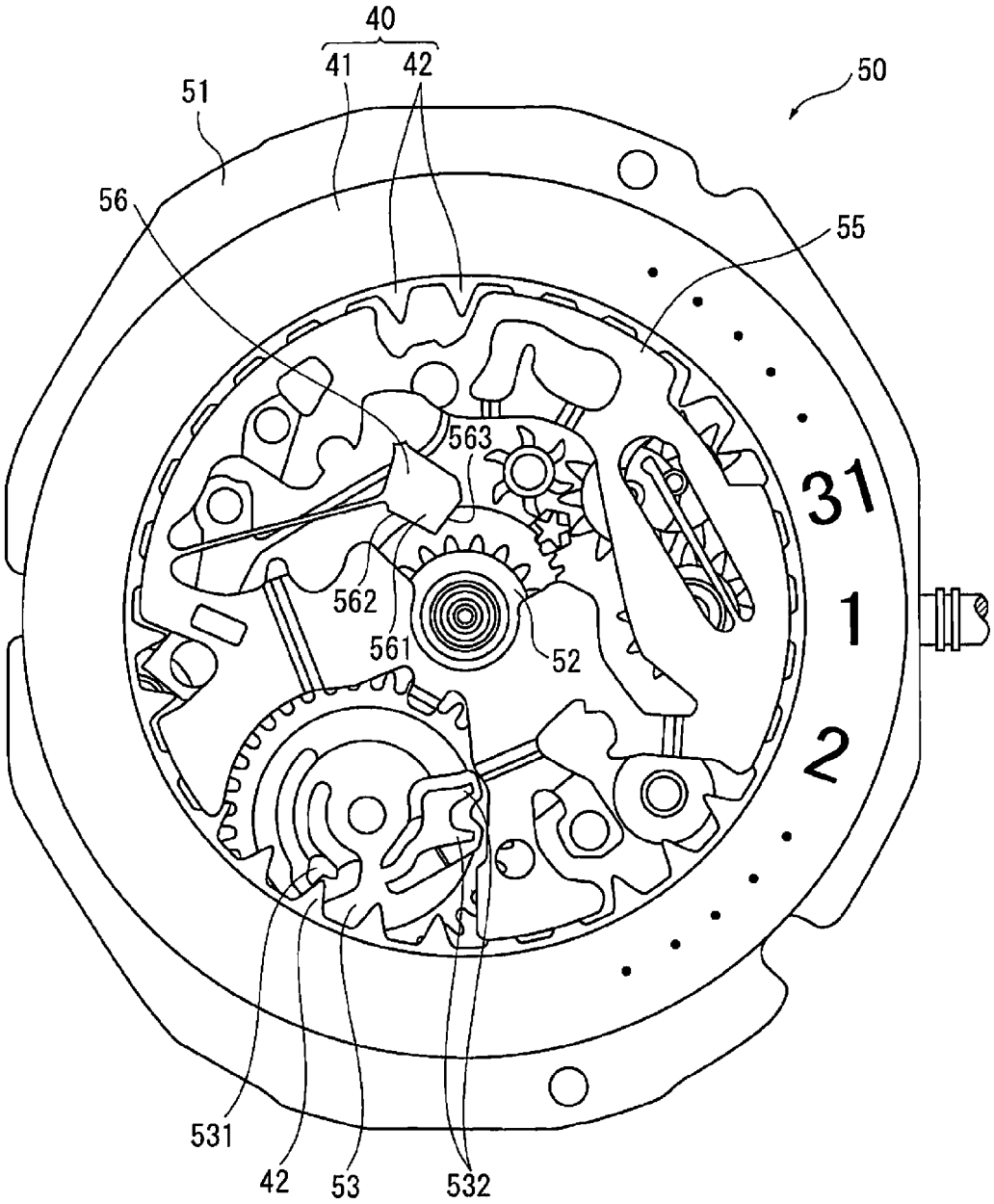
FIG. 3 is a plan view of a movement in the first embodiment.

FIG. 3 is a plan view of the movement 50 in which the date indicator 40 is incorporated and which is viewed from the side where the dial 20 is present. The date indicator 40 includes a date dial 41, which is formed in a ring shape, and an internal gear 42, which is formed integrally with the inner circumference of the date dial 41, as shown in FIG. 3. The internal gear 42 has 31 teeth formed along the inner circumference of the date dial 412. Date information, specifically, numerals from "1" to "31" representing the dates are printed on the front surface of the date dial 41 (surface facing dial 20).

Configuration of Day Indicator

Figure 4:
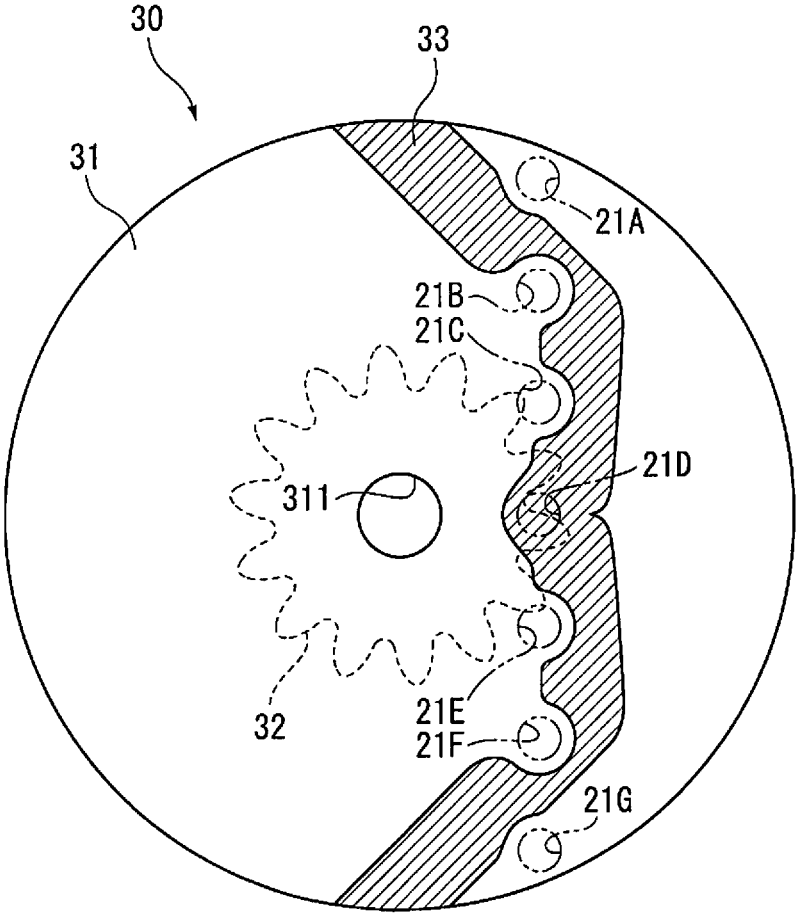
FIG. 4 is a plan view showing a day indicator in the first embodiment.

FIG. 4 is a plan view showing the day indicator 30. The day indicator 30 includes a day dial 31, which is formed in a disk shape, and a day star 32, which is fixed to the rear surface of the day dial 31, as shown in FIG. 4. The day star 32 has 14 teeth. An insertion hole 311, through which the indication hand shaft that supports the indication hands 12 to 14 is inserted, is formed at the centers of the day dial 31 and the day star 32.

Mark

A mark 33 is formed in a printing process on the front surface of the day dial 31 (surface facing dial 20), as shown in FIG. 4. The mark 33 is a single formed object having a predetermined area. The mark 33 is colored in a single color that differs from the color of the surface of the day dial 31 where no mark 33 is formed.

The shape and arrangement of the mark 33 are so set that the mark 33 sequentially appears through one of the openings 21A to 21G in the dial 20 in the order of the days of the week whenever the day dial 31 is rotated by the movement 50 by a predetermined angle (360°/7), as will be described later.

In the present embodiment, the mark 33 has portions each of which appears through the corresponding one of the openings 21A to 21G when the day dial 31 is rotated by the predetermined angle and portions that connect the appearing portions to each other, and the mark 33 is formed in a belt shape. Further, the mark 33 is formed continuously from an edge portion in a predetermined position at the outer circumference of the day dial 31 to another edge portion at the outer circumference of the day dial 31 that is located on the opposite side of the center of the day dial 31 to the edge portion in the predetermined position. Moreover, the mark 33 is formed symmetrically with respect to a straight line perpendicular to the straight line that connects the edge portion in the predetermined position to the other edge portion.

Configuration of Movement

The movement 50 includes a main plate 51, a battery and a stepping motor disposed on the rear side of the main plate 51, a circuit substrate in which a quartz oscillator that is a reference signal source and an IC (integrated circuit) that is a control circuit are incorporated, and train wheels that transmit drive force produced by the stepping motor to the indication hands, as shown in FIG. 3, as a typical movement for an analog quartz timepiece does. The train wheels include an hour wheel 52, to which the hour hand 12 is attached and which makes one revolution in 12 hours.

The movement 50 further includes a drive mechanism that drives the day indicator 30 and the date indicator 40 and a date indicator maintaining plate 55.

The drive mechanism that drives the day indicator 30 and the date indicator 40 includes a date indicator driving wheel 53, which operates together with the hour wheel 52 and makes one revolution in 24 hours. The date indicator driving wheel 53 includes a date finger 531, which advances the internal gear 42 of the date indicator 40 by an amount corresponding to one tooth in one day to rotate the date indicator 40 by an amount corresponding to one day.

The date indicator driving wheel 53 further includes a day finger 532, which advances the day star 32 to rotate the day indicator 30. That is, the date indicator driving wheel 53 also serves as a day indicator driving wheel.

The day finger 532 of the date indicator driving wheel 53 is formed of two day fingers 532. The day fingers 532 therefore rotate the day star 32 by an amount corresponding to two teeth whenever the date indicator driving wheel 53 makes one revolution. That is, the day indicator 30 rotates by 360/7 degrees in a day and makes one revolution in a week.

The teeth of the day star 32 are urged by a front end portion 561 of a day jumper 56 formed in the date indicator maintaining plate 55. The day jumper 56 always applies its own spring force to the front end portion 561 so that it is urged toward the teeth of the day star 32. The front end portion 561 has two inclined surfaces 562 and 563, which intersect each other at the front end of the front end portion 561. Therefore, when the day indicator 30 is rotated clockwise by the date indicator driving wheel 53, one of the teeth of the day star 32 comes into contact with the inclined surface 562 and presses down the day jumper 56 against the urging force thereof. When the tooth of the day star 32 goes over the front end portion 561, the tooth comes into contact with the inclined surface 563 and moves in the direction of the rotation. When two teeth come into contact with the inclined surfaces 562 and 563 and the front end portion 561 is located between the teeth, the day indicator 30 stops. When the day indicator 30 stops rotating, the movement of the day indicator 30 is restricted because the urging force of the day jumper 56 maintains the state of the day jumper 56 in which it engages with the two teeth of the day star 32.

The movement of the day indicator 30 is therefore restricted whenever the day indicator 30 is intermittently driven by the date indicator driving wheel (day indicator driving wheel) 53 and the day jumper 56.

Some timepieces are capable of displaying the days of the week in two languages, for example, in Japanese and English. In such a timepiece, characters representing the days of the weeks are alternately displayed in the two languages on the day dial along the outer circumference thereof, and a single opening that allows a user to visually recognize a day of the week displayed on the day dial is formed in the dial. The day star has 14 teeth and is advanced by the day fingers by an amount corresponding to two teeth in one day. In this configuration, shifting the position of the engagement between the day fingers and the teeth of the day star by an amount corresponding to one tooth allows a display form in which a day of the week in one of the languages is visible through an opening and a display form in which a day of the week in the other languages is visible through the opening to be switched from each other.

In the present embodiment, in consideration of driving the day indicator of such a timepiece, the day star 32 has the 14 teeth, and the date indicator driving wheel 53 has the two day fingers 532. Instead, for example, the day star 32 may have 7 teeth, the date indicator driving wheel 53 may have one day finger, and the day finger may rotate the day star 32 by an amount corresponding to one tooth whenever the date indicator driving wheel 53 makes one revolution.

Motion of Day Dial

Figure 5:
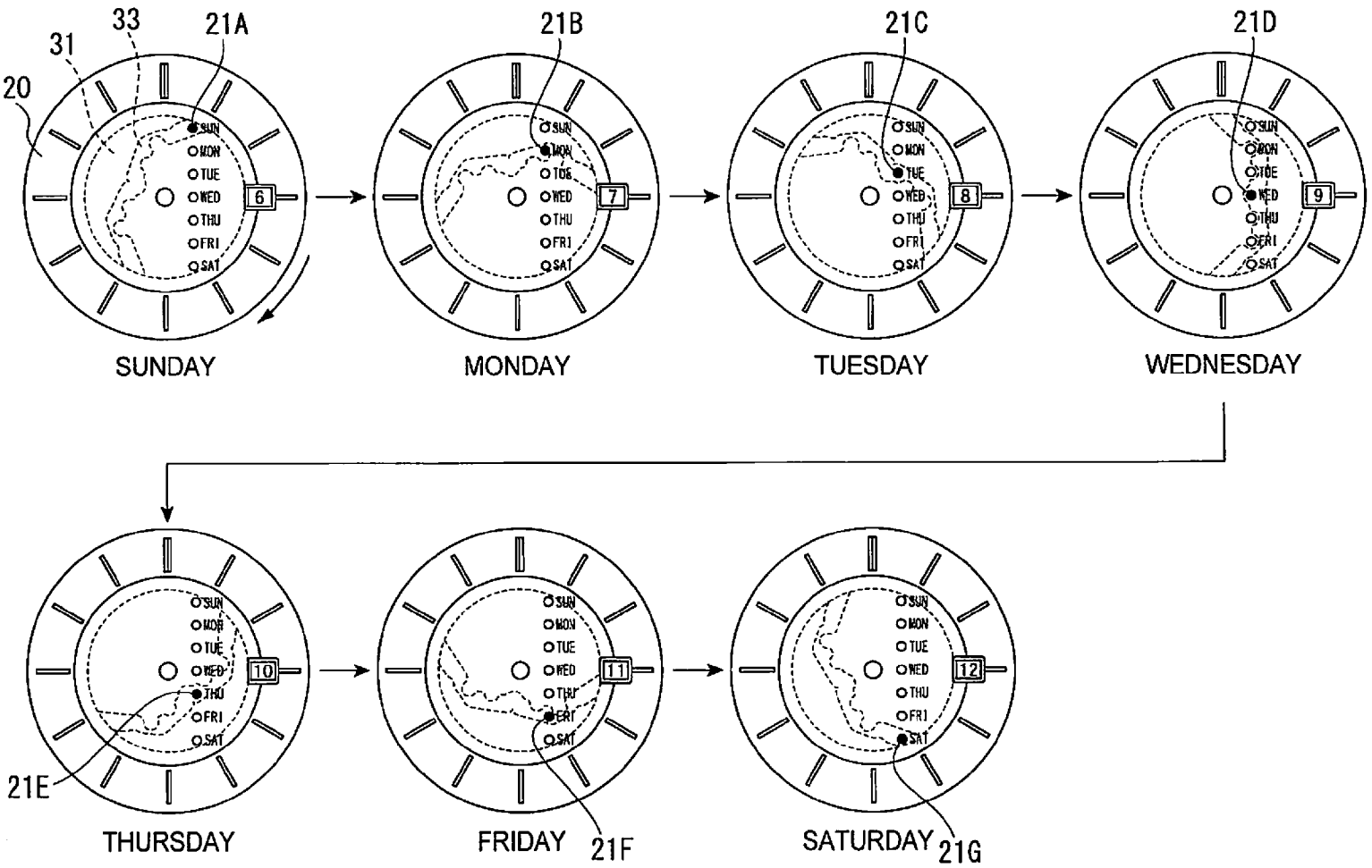
FIG. 5 shows the motion of a day dial in the first embodiment.

FIG. 5 shows the motion of the day dial 31. When the timepiece 1 indicates Sunday, the mark 33 formed on the day dial 31 appears through the opening 21A related to SUNDAY on the dial 20, as shown in FIG. 5. In this case, the mark 33 does not appear through the other openings 21B to 21G.

From this state, when 0 A.M. is reached, the day dial 31 rotates clockwise (in right-handed direction) by 360/7 degrees. As a result, the mark 33 disappears from the opening 21A but appears through the opening 21B related to MONDAY. In this case, the mark 33 does not appear through the other openings 21C to 21G.

Further, when 0 A.M. is reached on the following day, the day dial 31 rotates clockwise by 360/7 degrees. As a result, the mark 33 disappears from the opening 21B but appears through the opening 21C related to TUESDAY. In this case, the mark 33 does not appear through the other openings 21A, 21D to 21G.

As described above, whenever 0 A.M. is reached, the day dial 31 rotates clockwise by 360/7 degrees, and the mark 33 therefore disappears from the opening through which the mark 33 has appeared but appears through the opening related to the following day of the week.

The user can therefore grasp the day of the week by visually recognizing which of the openings 21A to 21G the mark 33 appears through.

Advantageous Effects of First Embodiment

The seven openings 21A to 21G corresponding to the seven days of the week are formed in the order thereof in the dial 20, and whenever the day dial 31 rotates by the predetermined angle, the mark 33 sequentially appears in the order of the days of the week through one of the openings 21A to 21G. The user can therefore intuitively grasp the day of the week by recognizing which opening numbered in the arrangement order of the openings 21A to 21G the mark 33 appears through.

Since the openings 21A to 21G are arranged at predetermined intervals, the user can readily grasp which opening numbered in the arrangement order of the openings 21A to 21G the mark 33 appears through, as compared with a case where the openings are arranged at randomly varying intervals. Further, the arrangement described above allows the shape and arrangement of the mark 33 to be readily designed.

The openings 21A to 21G are arranged in the order of the days of the week from above to below or in the typical vertical arrangement order of the days of the week, whereby the user can readily grasp the day of the week when viewing the timepiece 1 from the front.

Since the mark 33 is colored in a single color, the mark 33 can be readily formed, as compared with a case where the mark 33 is colored in a plurality of colors.

Since the symbols representing the days of the weeks are displayed on the dial 20 in correspondence with the openings 21A to 21G, the user can further grasp which day of the week is indicated by the opening through which the mark 33 appears by visually recognizing the corresponding symbol displayed on the dial 20, whereby the user can more readily grasp the day of the week.

The mark 33 has not only the portions that appear through one of the openings 21A to 21G when the day dial 31 rotates by the predetermined angle but also portions that connect the appearing portions to each other, and the mark 33 has a belt-like shape. The configuration described above allows the entire shape of the mark 33 to be changed in accordance with the type of the day dial. As a result, when a plurality of types of day dials are handled at the time of assembly of the timepiece, the day dials can be readily distinguished from each other.

Second Embodiment

A timepiece according to a second embodiment differs from the timepiece 1 according to the first embodiment in terms of the positions of the openings formed in the dial and corresponding to the seven days of the week and the mark formed on the day dial. The other configurations of the timepiece according to the second embodiment are the same as those of the timepiece 1. The same configurations as those of the timepiece 1 have the same reference characters and will not be described.

Figure 6:
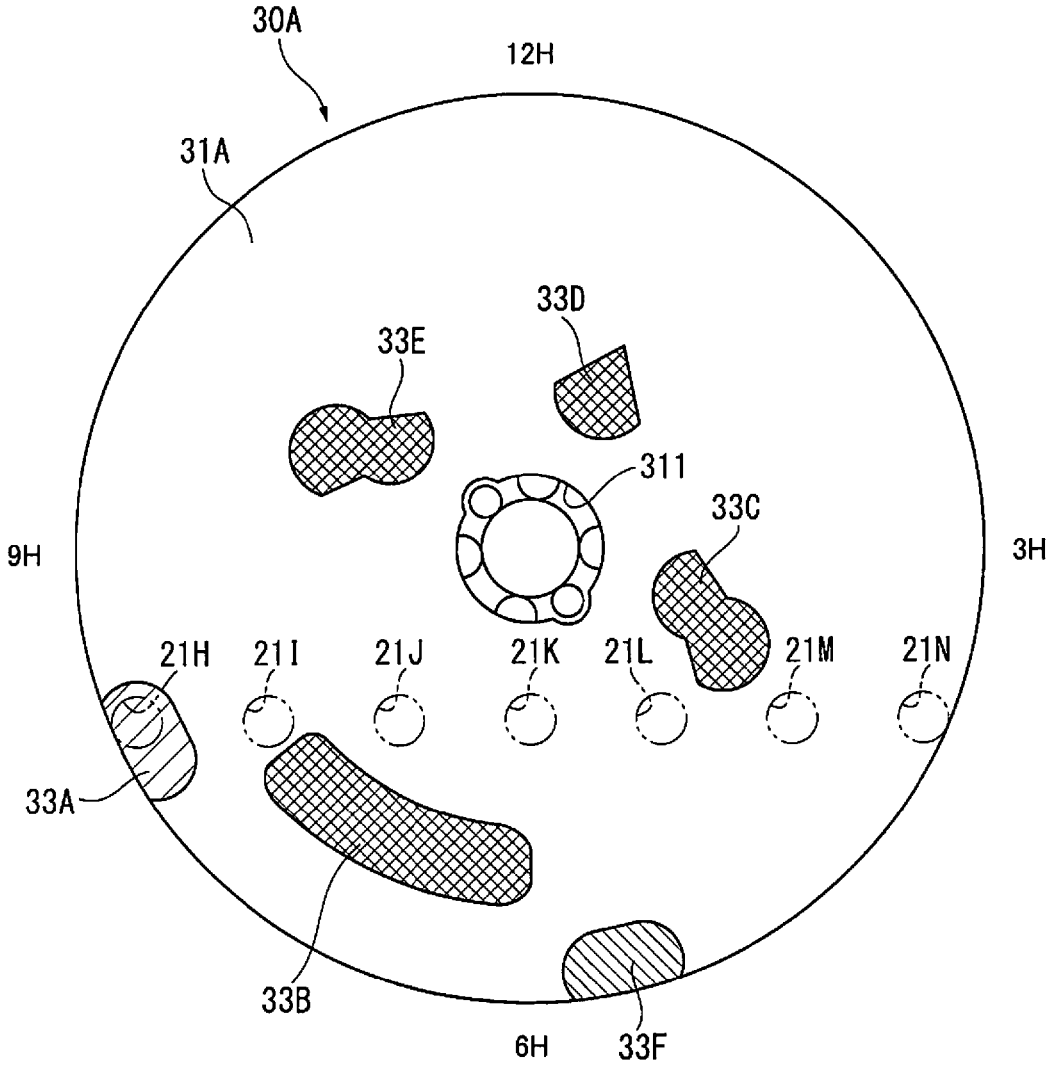
FIG. 6 is a plan view showing a day indicator according to a second embodiment of the invention.

In the timepiece according to the second embodiment, the dial has seven openings 21H to 21N formed therein, and the openings 21H to 21N correspond to the seven days of the week and are formed on the side shifted from the center line connecting the 9-o'clock position to the 3-o'clock position toward the 6-o'clock position and in the direction parallel to the center line and oriented from the 9-o'clock position toward the 3-o'clock position in the order of the days of the week, that is, from Sunday to Saturday (see FIG. 6). The openings 21H to 21N are arranged at predetermined intervals.

Although not shown, symbols representing the days of the week are displayed on the dial in correspondence with the openings 21H to 21N, as on the dial 20 in the first embodiment.

FIG. 6 is a plan view showing a day indicator 30A in the second embodiment. Six mark portions 33A to 33F set apart from each other are formed in a printing process on the front surface of a day dial 31A. Each of the mark portions 33A to 33F is a single formed object having a predetermined area. The mark portions 33A to 33F form the mark in an embodiment of the invention.

The shapes and arrangement of the mark portions 33A to 33F are so set that whenever the day dial 31A rotates by a predetermined angle (360/7 degrees), one of the mark portions 33A to 33F sequentially appears in the order of the days of the week through the corresponding one of the openings 21H to 21N in the dial.

The mark portion 33A appears through the opening 21H corresponding to Sunday. The mark portion 33B appears through the opening 21I corresponding to Monday and the opening 21M corresponding to Friday. The mark portion 33C appears through the opening 21J corresponding to Tuesday. The mark portion 33D appears through the opening 21K corresponding to Wednesday. The mark portion 33E appears through the opening 21L corresponding to Thursday. The mark portion 33F appears through the opening 21N corresponding to Saturday.

The colors of the mark portions 33A to 33F differ from the color of the surface of the day dial 31A where no mark portions 33A to 33F are formed. The colors of the mark portions 33A to 33F are set in accordance with the days of the week related to the openings through which the mark portions appear. In the present embodiment, the mark portion 33A, which appears through the opening 21H corresponding to Sunday, is red. The mark portions 33B to 33E, which appear through the openings 21I to 21M corresponding to Monday to Friday, are black. The mark portion 33F, which appears through the opening 21N corresponding to Saturday, is blue.

Figure 7:
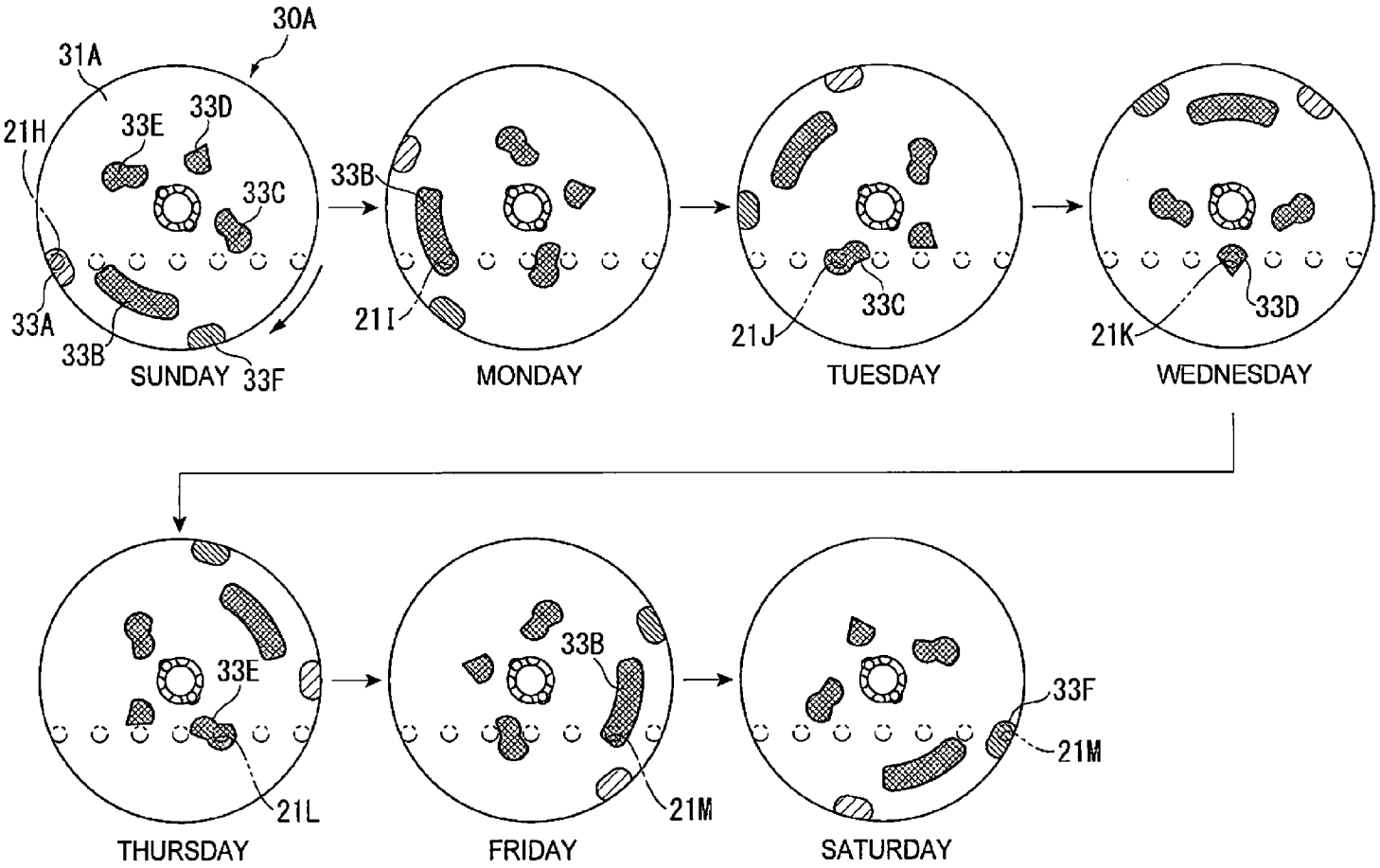
FIG. 7 shows the motion of a day dial in the second embodiment.

FIG. 7 shows the motion of the day dial 31A. When the timepiece 1 indicates Sunday, the mark portion 33A formed on the day dial 31A appears through the opening 21H related to Sunday, as shown in FIG. 7. In this case, the mark portions 33B to 33F do not appear through the other openings 21I to 21N.

From this state, when 0 A.M. is reached, the day dial 31A rotates clockwise (in right-handed direction) by 360/7 degrees. As a result, the mark portion 33A disappears from the opening 21H, but the mark portion 33B appears through the opening 21I related to Monday. In this case, the mark portions 33C to 33F do not appear through the other openings 21J to 21N.

Further, when 0 A.M. is reached on the following day, the day dial 31A rotates clockwise by 360/7 degrees. As a result, the mark portion 33B disappears from the opening 21I, but the mark portion 33C appears through the opening 21J related to Tuesday. In this case, the mark portions 33A, 33D to 33F do not appear through the other openings 21H, 21K to 21N.

As described above, whenever 0 A.M. is reached, the day dial 31A rotates clockwise by 360/7 degrees, and one of the mark portions 33A to 33F therefore disappears from the opening through which the mark portion has appeared, but one of the mark portions 33A to 33F appears through the opening related to the following day of the week.

The user can therefore grasp the day of the week by visually recognizing which of the openings 21H to 21N any of the mark portions 33A to 33F appears through.

In the present embodiment, the day star of the day indicator 30A has 14 teeth, as in the first embodiment. In this configuration, when the day star engages with the day fingers in a position shifted from a reference position set in advance by an amount corresponding to one tooth, the day of the week is not displayed correctly in some cases because the day dial 31A stops at a position of rotation shifted by 360/14 degrees from any of the positions of rotation for the days of the week shown in FIG. 7. In this case, to notify the user of incorrect engagement between the day fingers and the day star, the shapes and arrangement of the mark portions 33A to 33F are so skillfully set that mark portions appear through two of the openings when the day dial 31A is rotated.

In the present embodiment, when the day fingers and the day star do not engage with each other correctly, for example, when the position of rotation of the day dial 31A is an intermediate position between the position of rotation for Sunday and the position of rotation for Monday shown in FIG. 7, the mark portion 33B appears through the opening 21I and the mark portion 33C appears through the opening 21L at the same time.

Advantageous Effects of Second Embodiment

The timepiece according to the second embodiment, which has a configuration similar to that of the timepiece 1 according to the first embodiment, can provide the same advantageous effects. The timepiece according to the second embodiment can further provide the following advantages.

Since the openings 21H to 21N are arranged in the order of the days of the week from left to right as in the case of the days of the week in a typical calendar, the user can readily grasp the day of the week when viewing the timepiece from the front.

Further, since each of the colors of the mark portions 33A to 33F is set in accordance with the day of the week (Sunday, Saturday, or any other day of the week) related to one of the openings 21H to 21N through which the mark portion appears, the user can also grasp the day of the week (Sunday, Saturday, or any other day of the week) based on the color of the mark portion that appears through one of the openings 21H to 21N.

Other Embodiments

The invention is not limited to the embodiments described above, and a variety of variations can be implemented to the extent that they fall within the substance of the invention.

In each of the embodiments described above, the openings formed in the dial and corresponding to the seven days of the week are arranged at predetermined intervals, but the invention is not necessarily configured this way. That is, the openings may be arranged at randomly varying intervals.

In the first embodiment described above, the openings 21A to 21G are arranged in parallel to the straight line connecting the 12-o'clock position to the 6-o'clock position on the dial 20 in the order of the days of the week in the direction from the 12-o'clock position toward the 6-o'clock position, but the invention is not necessarily configured this way. For example, the openings 21A to 21G may be arranged in the order of the days of the week in the direction from the 6-o'clock position toward the 12-o'clock position. Instead, the openings 21A to 21G may be arranged in parallel to the straight line connecting the 9-o'clock position to the 3-o'clock position or may be arranged obliquely with respect to the straight line connecting the 12-o'clock position to the 6-o'clock position. The arrangements described above can be achieved with no change in the configuration of the day dial 31.

In the second embodiment described above, the openings 21H to 21N are arranged in parallel to the straight line connecting the 9-o'clock position to the 3-o'clock position on the dial in the order of the days of the week in the direction from the 9-o'clock position toward the 3-o'clock position, but the invention is not necessarily configured this way. For example, the openings 21H to 21N may be arranged in the order of the days of the week in the direction from the 3-o'clock position toward the 9-o'clock position. Instead, the openings 21H to 21N may be arranged in a direction parallel to the straight line connecting the 12-o'clock position to the 6-o'clock position or may be arranged obliquely with respect to the straight line connecting the 9-o'clock position to the 3-o'clock position. The arrangements described above can be achieved with no change in the configuration of the day dial 31A.

In each of the embodiments described above, the openings formed in the dial and corresponding to the seven days of the week are arranged along a straight line, but the invention is not necessarily configured this way. That is, the openings are not necessarily arranged along a straight line. For example, the openings may be arranged along a curved line. In this case, the openings may be arranged along a curved line along the outer circumference of the dial or may be arranged along a curved line having curvature different from that of the curved line along the outer circumference. The openings may still instead be arranged in a zigzag pattern.

In the first embodiment described above, the mark 33 is colored in a single color, but the invention is not necessarily configured this way. For example, the color of a portion that appears through any of the openings 21A to 21G when the day dial 31 rotates by the predetermined angle may be set in accordance with the day of the week related to the opening through which the portion appears.

In the second embodiment described above, the colors of the mark portions 33A to 33F are set in accordance with the days of the weeks related to the openings through which the mark portions appear, but the invention is not necessarily configured this way. For example, the mark portions 33A to 33F may have the same color.

In each of the embodiments described above, the symbols representing the days of the week are displayed on the dial, but the invention is not necessarily configured this way. For example, in the case of a timepiece for women or a timepiece that is otherwise small, in which the dial has a narrower space, the symbols described above may not be displayed on the dial.

In each of the embodiments described above, the openings formed in the dial and corresponding to the seven days of the week are arranged in the order of the days of the weeks from Sunday to Saturday, but the invention is not necessarily configured this way. For example, the openings may be arranged in the order of the days of the week from Monday to Sunday or may be arranged in the order of the days of the week from Saturday to Friday.

In each of the embodiments described above, each of the openings formed in the dial and corresponding to the seven days of the week is formed in a circular shape, but the invention is not necessarily configured this way. For example, the openings may be formed each in a rectangular shape or may be formed in shapes different from one another.

In the second embodiment described above, each of the mark portions 33A to 33F is a formed object having a predetermined area, but the invention is not necessarily configured this way. For example, each of the mark portions 33A to 33F may be a formed object that displays a symbol.

In this case, a character representing each of the days of the week in two languages, such as Japanese and English, may be formed as the corresponding mark portion on the day indicator 30A, and the position of the engagement between the day fingers and the teeth of the day star may be shifted by an amount corresponding to one tooth to switch a display form in which the character in one of the languages is visible through any of the openings 21H to 21N and a display form in which the character in the other languages is visible through the opening to each other.

In each of the embodiments described above, a mark that appears through any of the openings formed in the dial and corresponding to the seven days of the week disappears from the opening through which the mark has appeared when the day dial rotates by the predetermined angle, but the invention is not necessarily configured this way.

Figure 8:
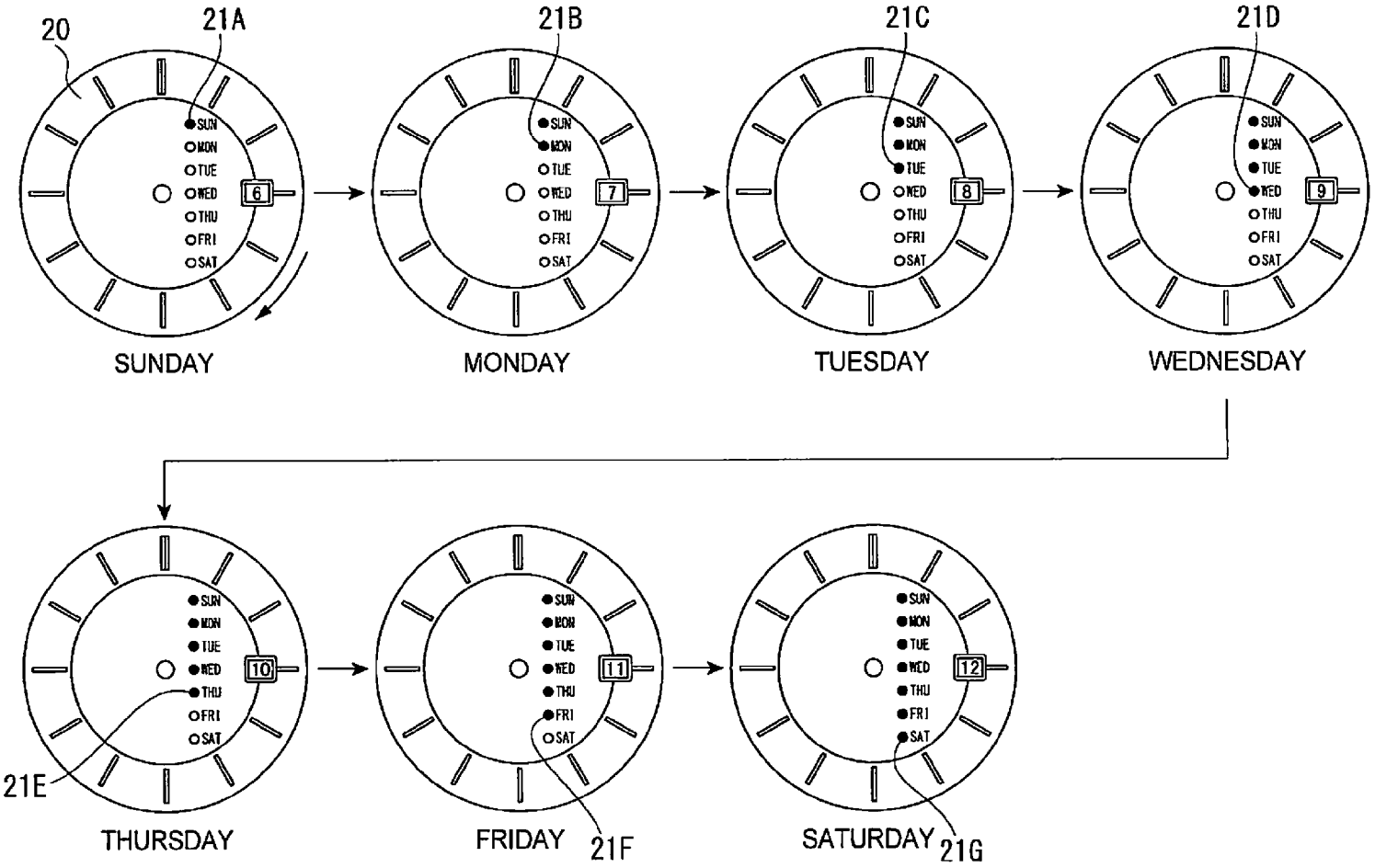
FIG. 8 shows motion of a day dial according to a variation of the invention.

For example, in the first embodiment described above, a configuration in which the mark 33 always appears through the opening 21A and the mark that appears through the openings 21B to 21G does not disappear until the following Sunday may be employed, as shown in FIG. 8. That is, the number of openings 21B to 21G through which the mark 33 appears may be incremented by one. The same holds true for the second embodiment.

The entire disclosure of Japanese Patent Application No. 2014-241479, filed Nov. 28, 2014 is expressly incorporated by reference herein.

What is claimed is:

1. A timepiece comprising:

a dial;

a day dial disposed on a rear side of the dial; and a movement that rotates the day dial by a predetermined angle every day, wherein seven openings are formed in the dial, the seven openings corresponding to the seven days of the week and being arranged at predetermined intervals in the order of the days of the week in a direction parallel to a straight line connecting a 12-o'clock position to a 6-o'clock position on the dial and oriented from the 12-o'clock position toward the 6-o'clock position, a mark is formed on a surface of the day dial on the side facing the dial, and whenever the day dial rotates by the predetermined angle, the mark sequentially appears in the order of the days of the week through one of the seven openings when the dial is viewed from a front side.

2. A timepiece comprising:

a dial;

a day dial disposed on a rear side of the dial; and a movement that rotates the day dial by a predetermined angle every day, wherein seven openings are formed in the dial, the seven openings corresponding to the seven days of the week and being arranged at predetermined intervals in the order of the days of the week in a direction parallel to a straight line connecting a 9-o'clock position to a 3-o'clock position on the dial and oriented from the 9-o'clock position toward the 3-o'clock position, a mark is formed on a surface of the day dial on the side facing the dial, and whenever the day dial rotates by the predetermined angle, the mark sequentially appears in the order of the days of the week through one of the seven openings when the dial is viewed from a front side.

3. The timepiece according to claim 1, wherein the mark is colored in a single color.

4. The timepiece according to claim 2, wherein the mark is colored in a single color.

5. The timepiece according to claim 1, wherein the mark is formed of a plurality of mark portions that appear through different openings of the seven openings, and the colors of the plurality of mark portions are set in accordance with the days of the week related to the openings through which the marks appear.

6. The timepiece according to claim 2, wherein the mark is formed of a plurality of mark portions that appear through different openings of the seven openings, and the colors of the plurality of mark portions are set in accordance with the days of the week related to the openings through which the marks appear.

7. The timepiece according to claim 1, wherein symbols representing the days of the week are displayed on the dial in correspondence with the seven openings.

8. The timepiece according to claim 2, wherein symbols representing the days of the week are displayed on the dial in correspondence with the seven openings.

* * * * *